US008403456B2

(12) United States Patent
Kuroda et al.

(10) Patent No.: US 8,403,456 B2
(45) Date of Patent: Mar. 26, 2013

(54) FLUID DROPLET DISCHARGE DEVICE AND A HEAD CLEANING CONTROL METHOD FOR A FLUID DROPLET DISCHARGE DEVICE

(75) Inventors: Kiyomi Kuroda, Nagano-ken (JP); Hiroyuki Motoyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 438 days.

(21) Appl. No.: 12/509,142

(22) Filed: Jul. 24, 2009

(65) Prior Publication Data

US 2010/0026753 A1 Feb. 4, 2010

(30) Foreign Application Priority Data

Jul. 30, 2008 (JP) ..... 2008-195873

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS 6,719,400 B2 4/2004 Inui et al.
6,860,579 B2 * 3/2005 Numata et al. ..... 347/23
2003/0156875 A1 8/2003 Inoue
2007/0229620 A1 * 10/2007 Yano ..... 347/86
2009/0167828 A1 * 7/2009 Ito et al. ..... 347/86

FOREIGN PATENT DOCUMENTS

| | | |
|---|---|---|
| JP | 2001-239679 | 9/2001 |
| JP | 2001-315351 | 11/2001 |
| JP | 2002-067291 | 3/2002 |
| JP | 2003-063035 | 3/2003 |
| JP | 2003-241951 | 8/2003 |
| JP | 2006-026969 | 2/2006 |
| JP | 2007-007960 | 1/2007 |
| JP | 2007-106019 | 4/2007 |
| JP | 2007-203662 | 8/2007 |

* cited by examiner

*Primary Examiner* — Matthew Luu
*Assistant Examiner* — Alejandro Valencia

(57) ABSTRACT

A fluid droplet discharge device executes a head cleaning process to quickly remove bubbles that have entered the fluid supply path when it is likely that bubbles have entered in a flushing process. If the ink cartridge cover 2*b* is opened during flushing and it is possible that bubbles have entered the ink supply path, ΔN1 is added to the count Na of the cleaning intensity setting counter N. If the count Na exceeds a threshold value Nmax in a head cleaning operation performed when a defective nozzle is detected, cleaning (CL4) with the highest cleaning intensity level is applied. Because ΔN1 is added to the count Na if the ink cartridge cover 2*b* is opened when flushing, the timing when this cleaning operation (CL4) is applied is accelerated. Bubbles that have entered the fluid supply path can therefore be removed sooner.

4 Claims, 9 Drawing Sheets

FLUID DROPLET DISCHARGE DEVICE AND A HEAD CLEANING CONTROL METHOD FOR A FLUID DROPLET DISCHARGE DEVICE

CROSS-REFERENCE TO RELATED APPLICATIONS

Japanese Patent application No. 2008-195873 is hereby incorporated by reference in its entirety.

BACKGROUND

1. Field of Invention

The present invention relates to a fluid droplet discharge device in which the fluid tank is connected through a fluid supply path to the fluid droplet discharge head when the access cover of the fluid tank loading unit closes, and the fluid tank disconnects from the fluid supply path to the fluid droplet discharge head when the access cover of the fluid tank loading unit opens. More particularly, the present invention relates to a head cleaning control method for a fluid droplet discharge device enabling efficiently recovering nozzles of the fluid droplet discharge device that are become faulty when bubbles enter the fluid supply path.

2. Description of Related Art

An inkjet printer having an inkjet head that prints by discharging ink droplets from nozzles is a common type of fluid droplet discharge device having a fluid droplet discharge head that discharges fluid droplets from a nozzle. The discharge of fluid droplets from a nozzle of the fluid droplet discharge head in such a fluid droplet discharge device can become deficient or not possible. Using an inkjet printer by way of example, the nozzles of the inkjet head can become clogged by an increase in the viscosity of the ink or other fluid droplets left inside a nozzle, by the intrusion of bubbles, or by adherence of foreign matter to the nozzles, resulting in the nozzle becoming unable to discharge ink droplets. A nozzle may also become partially clogged, resulting in a deficient discharge condition in which ink droplets of sufficient volume cannot be discharged. If printing proceeds using an inkjet head having nozzles in either of these conditions (referred to below as defective nozzles), print quality may drop as a result of dropped (non-printing) dots, for example. To prevent this, the inkjet head is moved regularly or at a predetermined timing to a position outside the printing area for head cleaning, which may include flushing to discharge ink droplets from each of the nozzles or an ink suction operation to vacuum ink from the nozzles.

Japanese Unexamined Patent Appl. Pub. JP-A-2007-7960 discloses a printer with a nozzle check function for checking the nozzles and cleaning the print head (referred to below as simply "head cleaning"). When the power turns on, this printer performs nozzle check and head cleaning operations as part of the startup process. The nozzle check also detects the number of defective nozzles, executes a head cleaning operation appropriate to the number of defective nozzles if the number of defective nozzles is greater than or equal to a user-defined threshold value, and does not execute the head cleaning operation if the number of defective nozzles is less than the threshold value.

Ink cartridges are generally used as the ink supply source in an inkjet printer. An ink cartridge loading unit is located in the inkjet printer, and an access cover is opened to load the ink cartridge. An ink supply opening is formed in the ink cartridge, and an ink supply needle that can be inserted into the ink supply opening is positioned on the ink cartridge loading unit side. When the access cover closes, the ink supply opening of the ink cartridge is pushed toward the ink supply needle and the ink supply needle is inserted to the ink supply opening. This connects the ink cartridge to the ink supply path of the inkjet head, and enables supplying ink. When the cover then opens, the ink supply opening of the ink cartridge separates from the ink supply needle and the ink supply needle is thus exposed to air. So that air bubbles do not enter the ink supply path from the ink supply needle exposed to the air when the ink cartridge is replaced, for example, a valve positioned in the ink supply path is closed to close the ink supply path. Japanese Unexamined Patent Appl. Pub. JP-A-2007-106019 discloses an inkjet printer having this type of ink supply unit.

If the access cover to the ink cartridge loading unit is opened while flushing the nozzles to prevent the nozzles from clogging, the possibility of bubbles being drawn into the ink supply path from the ink supply needle now exposed to air is strong. Bubbles that get inside the ink supply path gradually advance inside the ink supply path toward the nozzles of the inkjet head in conjunction with the ink supply operation. If a bubble reaches a nozzle, the nozzle will be unable to discharge ink droplets or will discharge ink droplets with insufficient volume. This makes head cleaning, which vacuums a large volume of ink from the nozzles, necessary in order to remove bubbles that have entered from the ink supply needle end of the ink supply path.

The literature is silent, however, about measures for removing bubbles that enter the fluid supply path when flushing occurs with the access cover to the ink tank loading unit or ink cartridge loading unit open.

SUMMARY OF INVENTION

A head cleaning method for a fluid droplet discharge device such as an inkjet printer according to the present invention executes a head cleaning process to quickly remove any bubbles that have entered the fluid supply path when it is possible that bubbles entered during flushing.

A first aspect of the invention is a head cleaning method for a fluid droplet discharge device in which a fluid supply path that supplies fluid to a fluid droplet discharge head is connected to a fluid supply opening of a fluid tank when an access cover closes, and the fluid supply path disconnects from the fluid supply opening when the access cover opens, including steps of: flushing by discharging fluid droplets from each nozzle of the fluid droplet discharge head; detecting if the access cover was opened during the flushing operation; and changing at least one of the cleaning intensity and the execution timing of a cleaning process executed after flushing if the access cover is detected to be open.

Preferably, of the cleaning processes that may be executed after flushing, the timing when the cleaning process with the highest cleaning intensity executes is accelerated if it is detected that the access cover was opened.

The head cleaning method for a fluid droplet discharge device according to the invention can increase the cleaning intensity of the next cleaning process executed, or the timing when a cleaning process with a high cleaning intensity executes can be accelerated, if it is detected that the access cover was opened during the flushing process. This enables quickly moving bubbles that have penetrated the fluid supply path to the nozzle for removal.

In order to prevent bubbles from entering during the flushing process, the head cleaning method for a fluid droplet discharge device according to another aspect of the invention also detects if the access cover is open before flushing starts, and if the access cover is open, closes the fluid supply path and then executes the flushing process when closing the access cover is detected.

To quickly remove any bubbles that have entered in the head cleaning method for a fluid droplet discharge device according to another aspect of the invention, the cleaning process is a fluid suction process that vacuums fluid from each nozzle of the fluid droplet discharge head, and increases the cleaning intensity using at least one of control to increase the fluid suction volume and control to increase the fluid suction power of the fluid suction process.

Further preferably, to prevent a loss of quality due to defective nozzles, the head cleaning method for a fluid droplet discharge device according to another aspect of the invention also has steps of executing a nozzle check to detect if any nozzle of the fluid droplet discharge head is a defective nozzle, and executing the cleaning process if a defective nozzle is detected.

Another aspect of the invention is a fluid droplet discharge device that executes a head cleaning process using the head cleaning control method described above, the fluid droplet discharge device having a fluid tank loading unit; an access cover that opens and closes the fluid tank loading unit; a cover linking mechanism that connects a fluid supply opening of a fluid tank set in the fluid tank loading unit to a fluid supply path that supplies fluid to a fluid droplet discharge head when the access cover closes, and disconnects the fluid supply opening from the fluid supply path when the access cover opens; an open/close sensor that detects opening and closing the access cover; a fluid suction unit that vacuums fluid from the nozzles of the fluid droplet discharge head; a nozzle check unit that detects if a nozzle of the fluid droplet discharge head is a defective nozzle; a flushing unit that flushes by discharging fluid droplets from each nozzle of the fluid droplet discharge head; and a head cleaning control unit that executes a cleaning process using the fluid suction unit to recover the defective nozzle when a defective nozzle is detected by the nozzle check unit, and changes at least one of the cleaning intensity and the execution timing of a cleaning process executed after flushing if the access cover is detected to be open.

To efficiently remove bubbles from the fluid supply path, the cleaning process with the highest cleaning intensity is preferably executed soon. A fluid droplet discharge device according to according to another aspect of the invention therefore preferably also has a cleaning intensity setting counter of which the count is incremented according to the occurrence of predetermined events. These predetermined events include detecting that the access cover is open. The head cleaning control unit executes the cleaning process with the highest cleaning intensity when the count of the cleaning intensity setting counter exceeds a predetermined threshold value.

The fluid droplet discharge device according to another aspect of the invention also has a valve that can close the fluid supply path. The head cleaning control unit detects, using the sensor, if the access cover is open before executing the flushing process, and if the access cover is open, closes the fluid supply path using the valve and then executes the flushing operation when closing the access cover is detected.

In the fluid droplet discharge device according to according to another aspect of the invention, the head cleaning control unit increases the cleaning intensity by at least one of applying control to increase the fluid suction volume of the fluid suction unit and applying control to increase the fluid suction power.

EFFECT OF THE INVENTION

When the cover of the fluid tank loading unit is detected to be open in the flushing process, control to increase the intensity of the cleaning process or control to execute the cleaning process at an earlier time is applied. As a result, bubbles that have gotten into the fluid supply path can be quickly removed. In addition, because the flushing process is not executed if the access cover is open before flushing starts, penetration of bubbles to the fluid supply path and defective nozzles resulting from bubbles in the fluid supply path can be prevented and quality can be maintained.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a fluid droplet discharge device according to the present invention is described below with reference to the accompanying figures. The embodiment described below applies the invention to an inkjet printer, but it will be evident that the invention can also be applied in the same way to fluid droplet discharge devices having a fluid droplet discharge head for discharging fluids other than ink. For example, the invention can also be applied to a fluid droplet discharge device for dispensing reagents.

General Configuration of an Inkjet Printer

Figure 1:
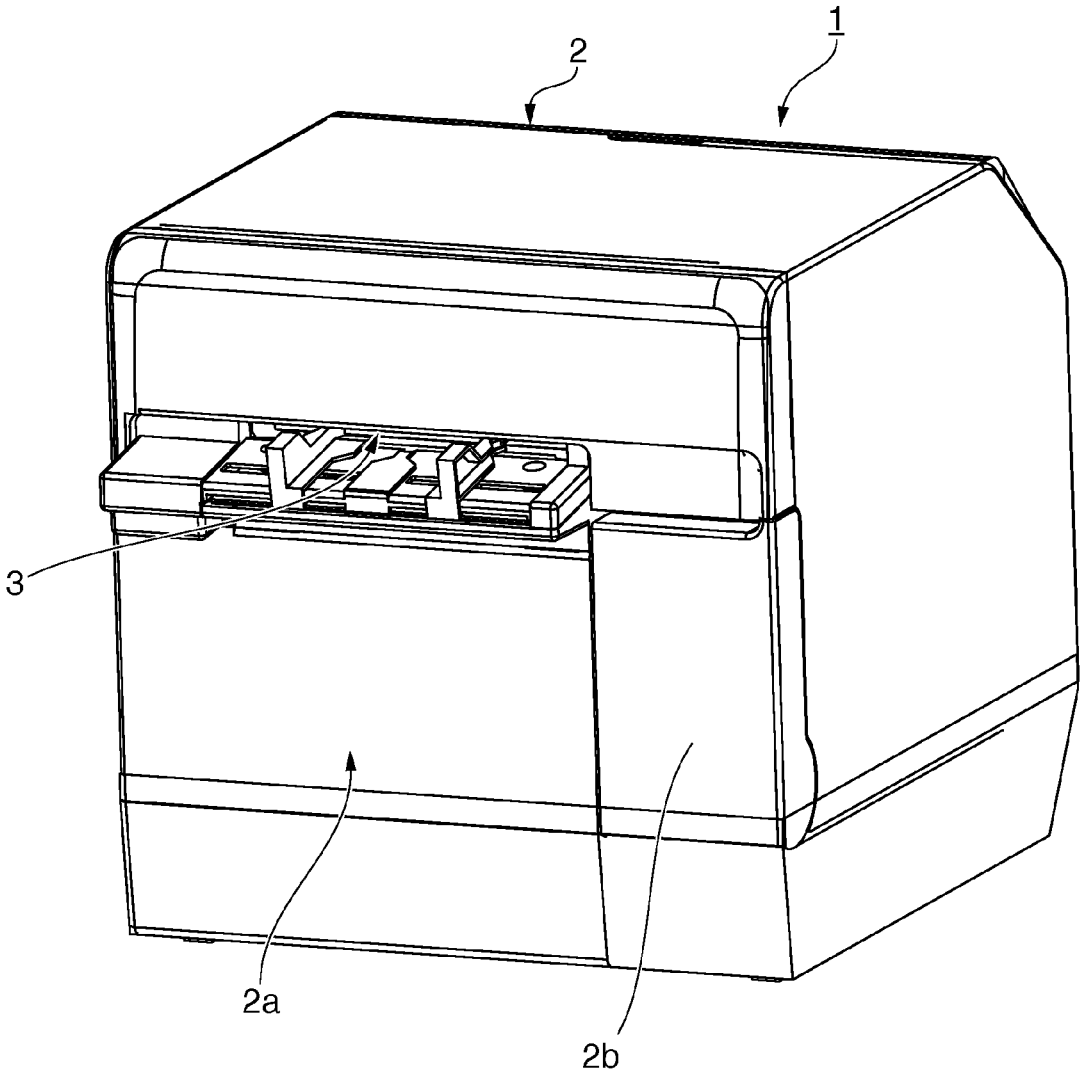
FIG. 1 is an external oblique view of an inkjet printer according to a preferred embodiment of the invention.
Figure 2:
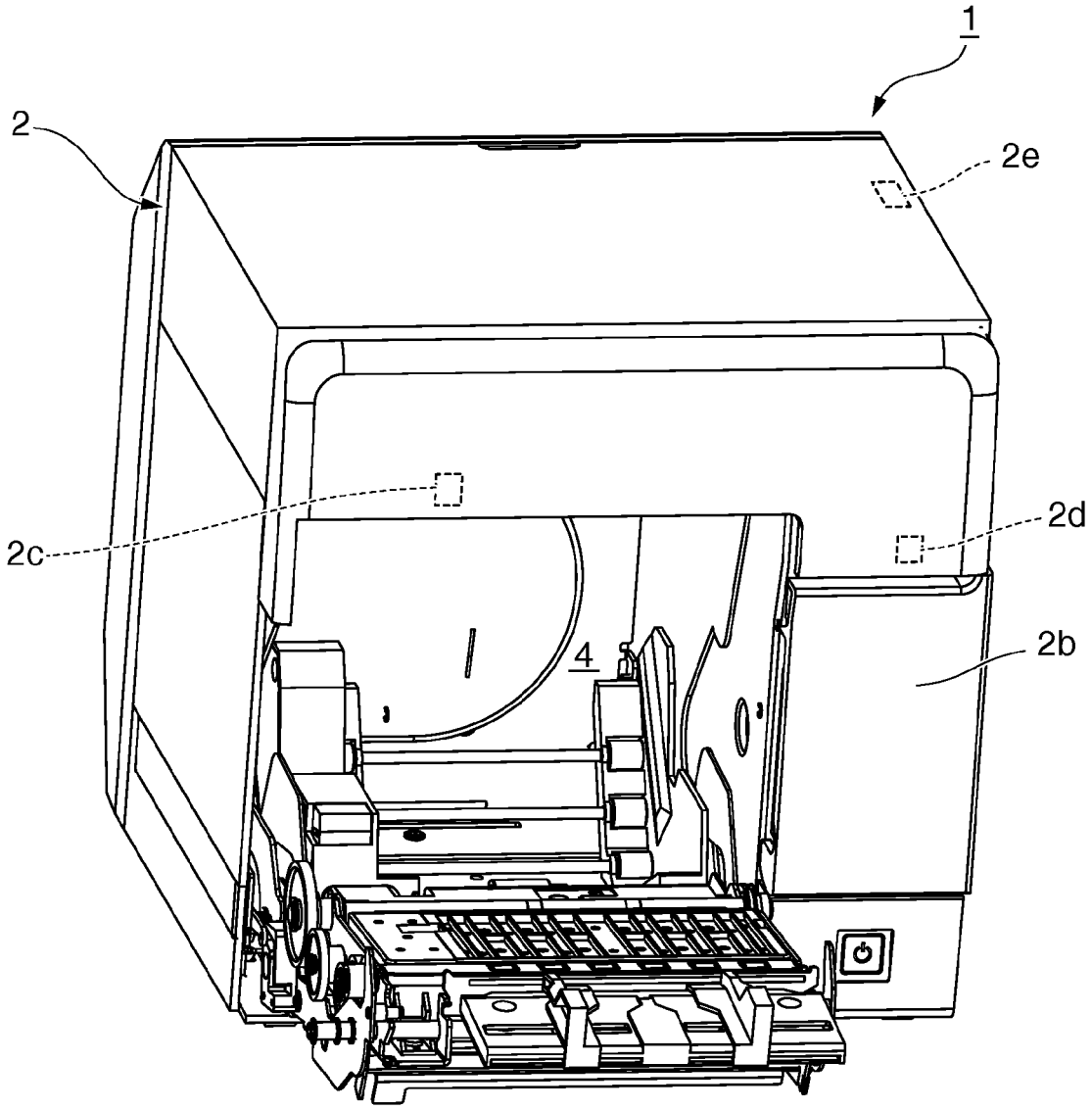
FIG. 2 is an external oblique view of the inkjet printer with the access cover open.
Figure 3:
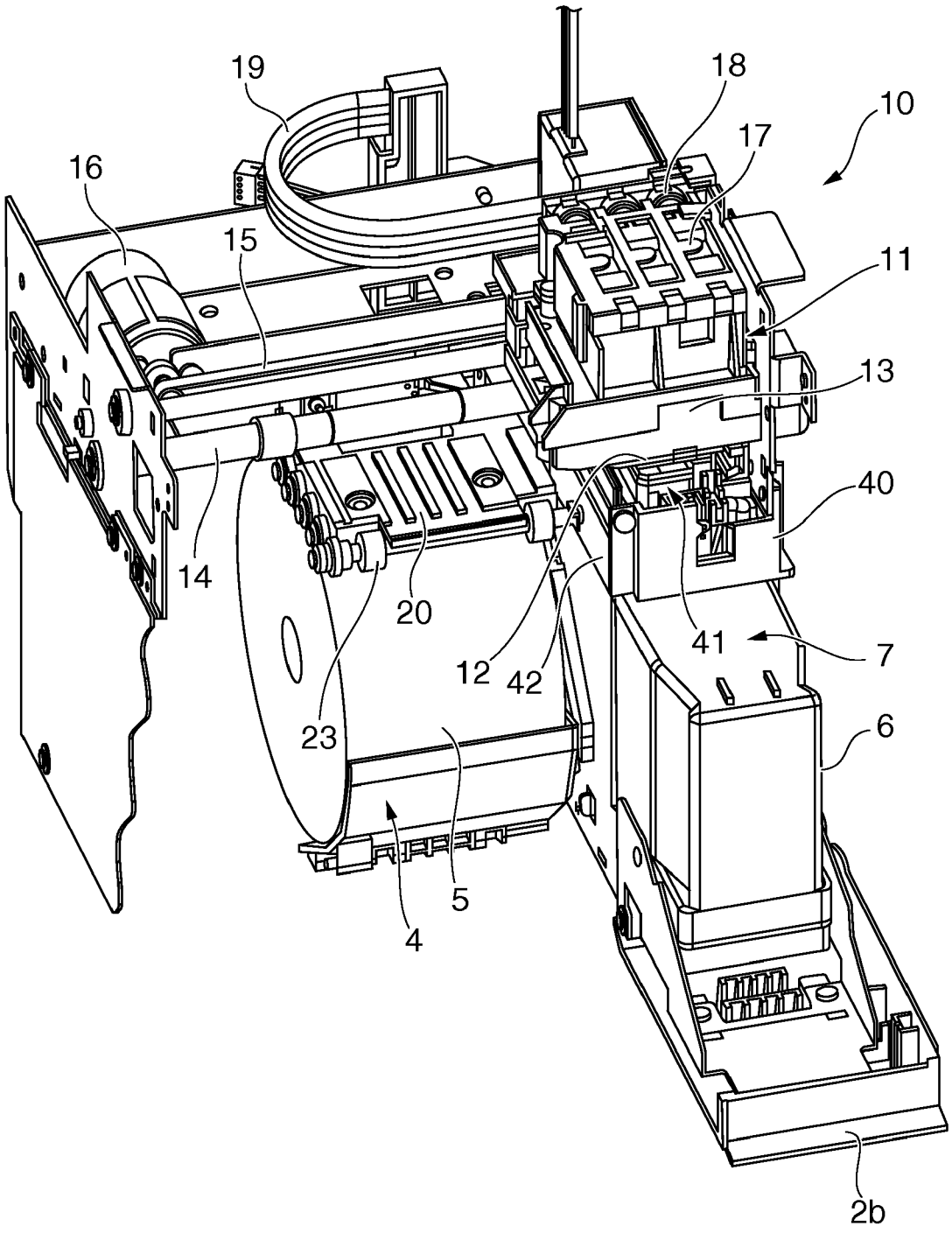
FIG. 3 is an oblique view of the printing mechanism unit of the inkjet printer.

FIG. 1 is an external oblique view of an inkjet printer, and FIG. 2 is an oblique view showing the internal construction of the same inkjet printer with the roll paper cover completely opened. FIG. 3 is an oblique view showing the printing mechanism unit with the outside case removed in order to show the internal structure of the inkjet printer.

Referring to these figures, the inkjet printer 1 has a box-like case 2. A roll paper cover 2*a* and an ink cartridge cover 2*b* (access covers) are positioned side by side at the front of the printer case 2, and a paper exit 3 for discharging the recording paper after printing is formed above the covers. When the roll paper cover 2*a* opens the roll paper compartment 4 formed inside the printer case 2 opens as shown in FIG. 2 and FIG. 3, and the roll paper 5 stored therein can be replaced or replenished. When the ink cartridge cover 2*b* opens, the ink cartridge loading unit 7 for loading an ink cartridge 6 loaded with ink opens as shown in FIG. 3, and the ink cartridge 6 can be installed or removed.

An open/close sensor 2*c* for detecting if the roll paper cover 2*a* closed, and an open/close sensor 2*d* for detecting if the ink cartridge cover 2*b* closed, are located in a front part of the case 2 near the edge of the opening communicating with the roll paper compartment 4 or ink cartridge compartment 7. An impact sensor 2*e* for detecting external shock applied to the inkjet printer 1 is also located at a specific position inside the case 2. This impact sensor 2*e* may operate using a piezoelectric material or position sensor to detect movement of a pendulum caused by acceleration at the time of impact.

The printing mechanism unit 10 that is enclosed by the printer case 2 includes a printing mechanism 11 located above the roll paper compartment 4, the ink cartridge loading unit 7 located on the right side of the roll paper compartment 4, and a head cleaning mechanism 40 located above the ink cartridge loading unit 7 as shown in FIG. 3. Other mechanisms such as a paper transportation mechanism for conveying the recording paper pulled from the roll paper 5 stored in the roll paper compartment 4 past the printing position of the printing mechanism 11, and a paper cutter mechanism located near the paper exit 3, are also provided.

Figure 4:
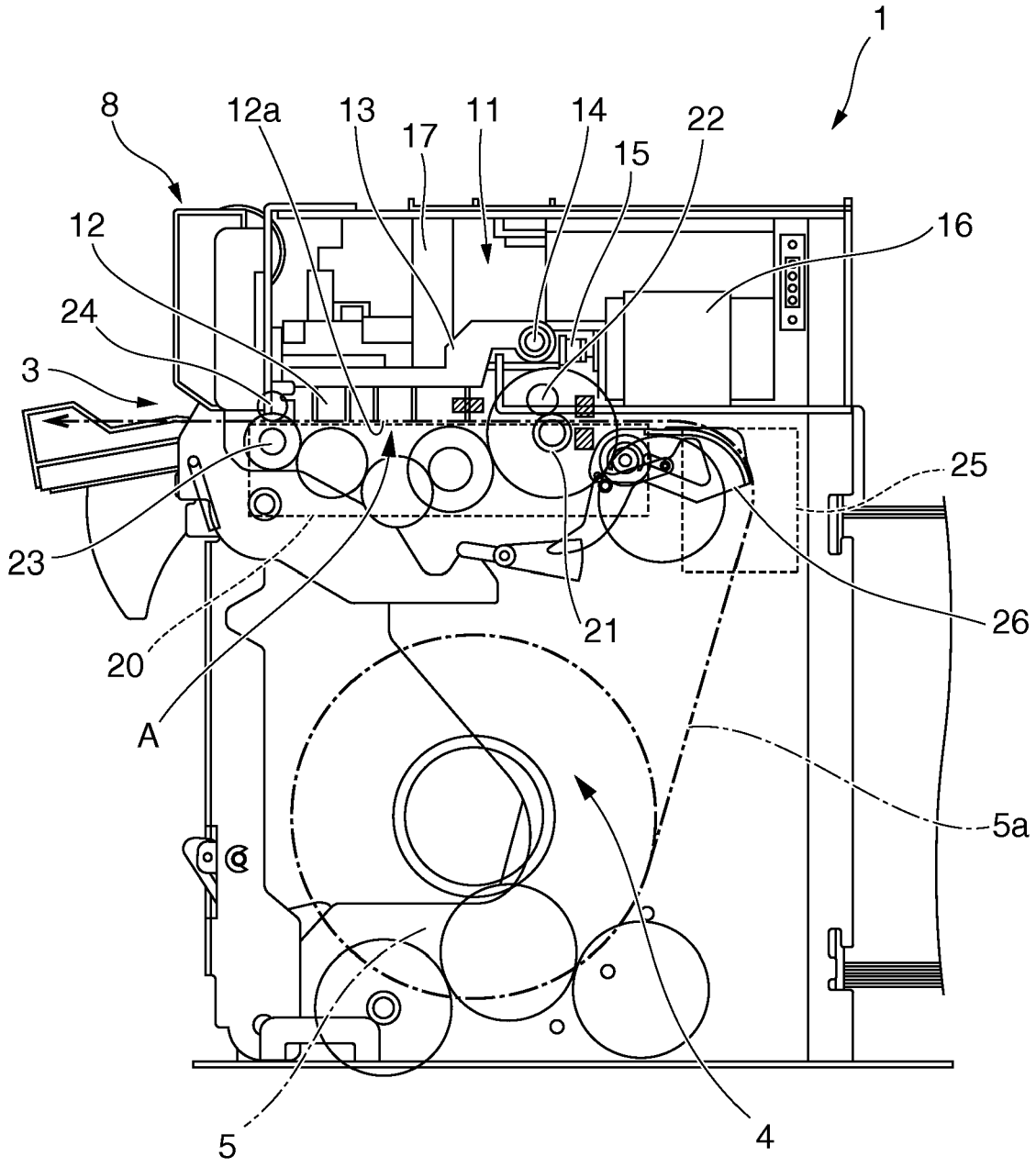
FIG. 4 is a vertical section view of the inkjet printer.

FIG. 4 is a schematic section view showing the internal structure of the inkjet printer 1. The internal structure of the inkjet printer 1 is described next with reference to FIG. 3 and FIG. 4. The printing mechanism 11 positioned above the roll paper compartment 4 and ink cartridge loading unit 7 includes an inkjet head 12, a carriage 13 on which the inkjet head 12 is mounted, and a horizontal carriage shaft 14 that guides the carriage 13. The carriage 13 is connected to the output shaft of a carriage motor 16 by a timing belt 15, and the inkjet head 12 travels bidirectionally widthwise to the printer, that is, across the width of the roll paper 5, in accordance with rotation of the carriage motor 16.

The inkjet head 12 has a nozzle surface 12*a* in which a plurality of nozzles for discharging ink are formed, and the nozzle surface 12*a* is exposed facing down on the bottom of the carriage 13. A back pressure adjustment unit 17 connected to the inkjet head 12 is positioned on top of the carriage 13, and the back pressure adjustment unit 17 is connected through a damper unit 18 (connected to its back) to the distal end of the ink supply tube 19. When the inkjet head 12 moves bidirectionally through the printing position on the platen 20 positioned horizontally above the roll paper compartment 4, ink droplets are discharged from the ink nozzles of the nozzle surface 12*a* to print on the printing paper 5*a* conveyed to the platen 20. When not printing, the inkjet head 12 moves to the right end of the carriage shaft 14 and stops at a standby position opposite the head cleaning mechanism 40 (the position shown in FIG. 3).

The paper transportation mechanism is described next with reference to FIG. 4. A rear paper feed roller 21 and a rear paper pressure roller 22 are positioned horizontally widthwise to the printer behind the platen 20 (that is, on the upstream side in the transportation direction). The rear paper pressure roller 22 is pressed from above with specific force against the rear paper feed roller 21 with the printing paper 5*a* therebetween.

A front paper feed roller 23 and a front paper pressure roller 24 are positioned in front of the platen 20. The front paper pressure roller 24 is pressed from above against the front paper feed roller 23 with the printing paper 5*a* therebetween. The rear paper feed roller 21 and front paper feed roller 23 are driven synchronously by the paper transportation motor 25.

The roll paper 5 is loaded by closing the roll paper cover 2*a* while holding a length of paper pulled out from the paper exit 3. The printing paper 5*a* pulled from the roll paper 5 inside the roll paper compartment 4 is conveyed through the transportation path past the printing position on the platen 20 with specific pressure applied to the paper by the tension guide 26. When the paper transportation motor 25 is controlled to drive, the rear paper feed roller 21 and front paper feed roller 23 rotate and the printing paper 5*a* is intermittently advanced a constant distance as each line is printed. The inkjet head 12 is driven synchronously to printing paper 5*a* transportation and prints on the surface of the printing paper 5*a* as it passes the printing position. Transportation stops with the printed printing paper 5*a* discharged from the paper exit 3, the printed portion at the leading end of the printing paper 5*a* is cut off by a paper cutting mechanism 8 positioned near the paper exit 3, and the printout is issued.

Figure 5A:
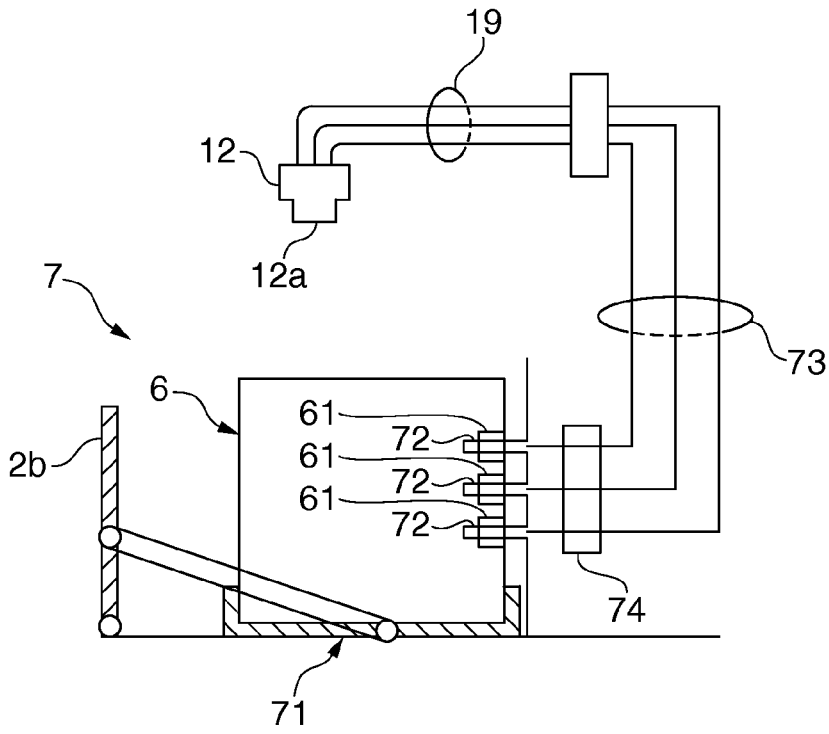
FIGS. 5A and 5B show the configuration of the ink cartridge loading unit.
Figure 5B:
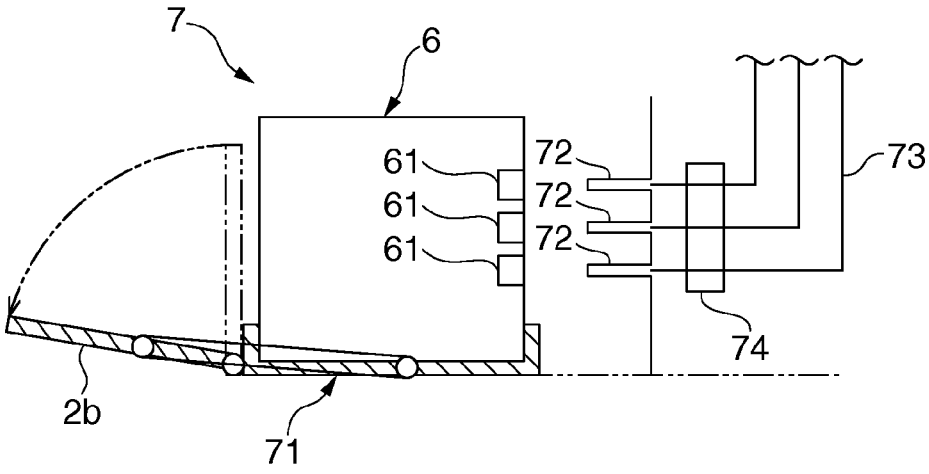

FIGS. 5A and 5B schematically illustrate the ink cartridge loading unit 7 and ink supply path. Referring to FIG. 3 and FIGS. 5A and 5B, the ink cartridge loading unit 7 has a linked slider 71 that slides forward and back in conjunction with opening and closing the ink cartridge cover 2*b*. A plurality of ink supply needles 72 protruding to the front are positioned in the back of the ink cartridge loading unit 7. The ink supply needles 72 are connected through an ink supply path 73 to corresponding ink supply tubes 19 that supply the ink to the inkjet head 12. A valve 74 that can close the ink supply path 73 is located in the ink supply path 73 at a position adjacent to the ink supply needles 72. Ink supply openings 61 enabling the ink supply needles 72 to be inserted thereto are formed in the back of the ink cartridge 6.

When the ink cartridge cover 2*b* is opened forward, the linked slider 71 moves forward in conjunction therewith. As shown in FIG. 5A, after an ink cartridge 6 is loaded into the linked slider 71, the ink cartridge cover 2*b* is closed, and the linked slider 71 is pushed to the back in conjunction with closing the cover. As a result, the ink supply needles 72 are inserted in the ink supply openings 61 of the ink cartridge 6, thereby connecting the ink cartridge 6 to the ink supply path 73 that supplies ink to the inkjet head 12.

When the ink cartridge cover 2*b* is opened to the position shown in FIG. 5B, the ink supply needles 72 of the ink supply path 73 are pulled out from the ink supply openings 61 of the ink cartridge 6, and the end of the ink supply hole formed in each ink supply needle 72 is exposed to air. In other words, the ink supply path 73 is disconnected from the ink supply openings 61. If the valve 74 is closed in this state, the ink supply path 73 is closed and bubbles are prevented from entering the ink supply path 73.

Head Cleaning Mechanism

Figure 6:
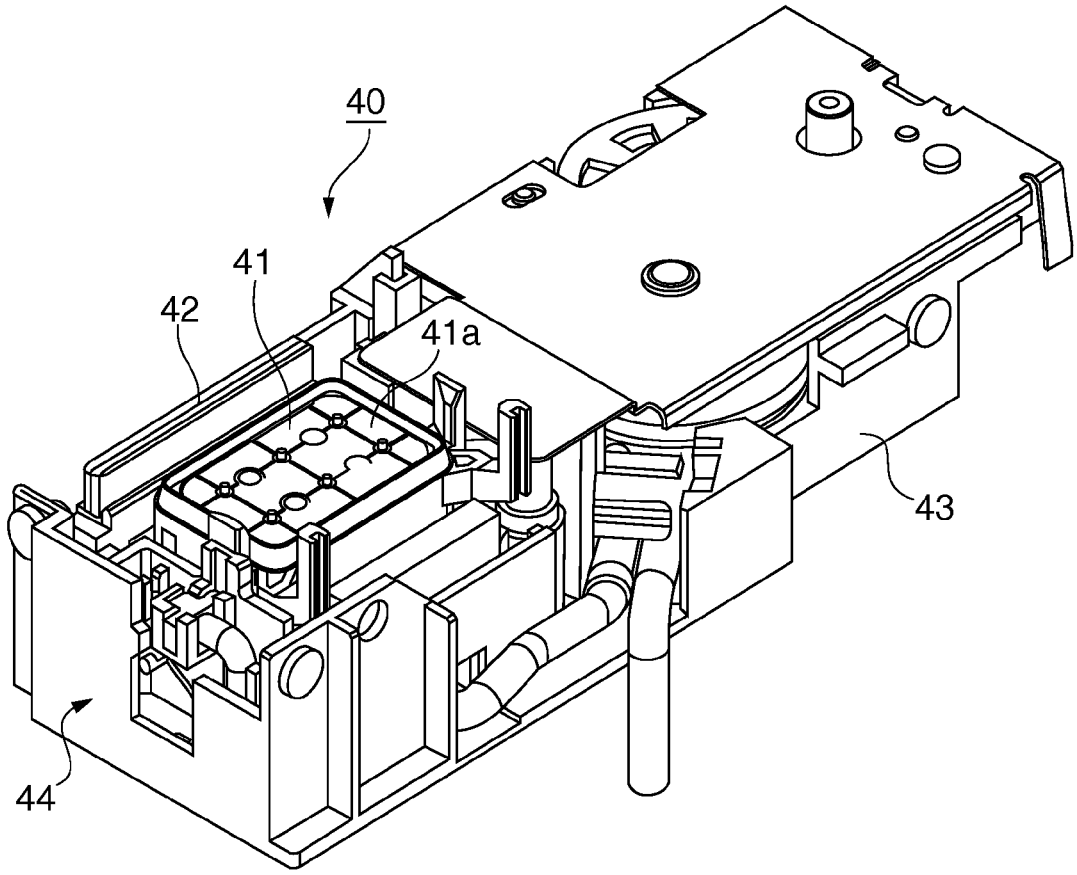
FIG. 6 is an oblique view of the head cleaning mechanism of the inkjet printer.

FIG. 6 is an oblique view of the head cleaning mechanism 40. The head cleaning mechanism 40 includes a head cap 41 that caps the nozzle surface 12*a* of the inkjet head 12, a wiper 42 that wipes ink and foreign matter from the nozzle surface 12*a*, and an ink suction unit 43 that vacuums ink that is left in or is clogging the ink nozzles of the inkjet head 12. The head cap 41, wiper 42, and ink suction unit 43 are positioned on the frame 44 of the head cleaning mechanism 40. The frame 44 is fastened to the main frame of the inkjet printer 1 that supports the carriage shaft 14 and platen 20, for example.

Figure 7:
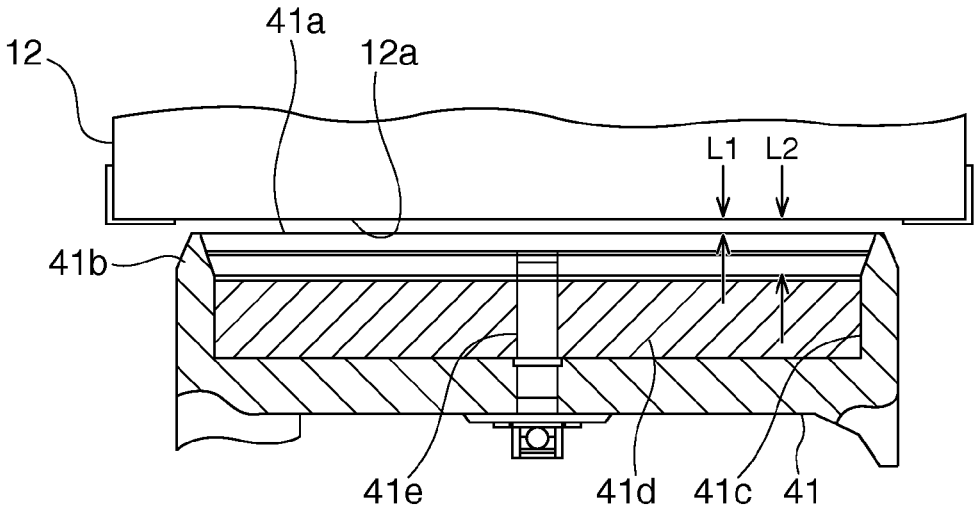
FIG. 7 shows the nozzle checking state of the head cleaning mechanism.

FIG. 7 is a partial section view showing the inkjet head 12 and the head cap 41 in direct opposition. The head cap 41 is located directly below the nozzle surface 12*a* in the standby position, and has a capping surface 41*a* facing up directly opposite the nozzle surface 12*a*. The head cap 41 can be slid perpendicularly to the nozzle surface 12*a*, that is, vertically perpendicularly to the carriage shaft 14 (FIG. 4), by operating a drive mechanism not shown. The head cap 41 can thus be moved in the directions causing the capping surface 41*a* to move to or away from the nozzle surface 12*a*.

The head cap 41 is made of rubber or other elastic material, and has a box-like shape with the edge portion 41*b* of the capping surface 41*a* rising vertically. The head cap 41 is of a size and shape enabling it to cover the part of the nozzle surface 12*a* where the nozzles are formed with the edge portion 41*b* surrounding and pressed to the nozzle surface 12*a*. A vacuum tube extending from the pump motor (not shown in the figure) of the ink suction unit 43 (FIG. 6) is connected to the inside of a well 41*c* surrounded by the capping surface 41*a* and edge portion 41*b*. When the pump motor is operated with the edge portion 41*b* against the nozzle surface 12*a*, suction from the pump motor creates a vacuum in the sealed space enclosed by the well 41*c* and nozzle surface 12*a*, causing ink left in the nozzles of the inkjet head 12 to be vacuumed out and discharged into the well 41*c*.

The wiper 42 (FIG. 6) is a flat member made of rubber or other elastic material, and is supported so that it can slide vertically on a guide member, not shown, fastened to the frame 44 of the head cleaning mechanism 40. Similarly to the head cap 41, the wiper 42 is rendered so that it can move perpendicularly to the nozzle surface 12*a* by operating a drive mechanism, not shown. When the wiper 42 wipes the nozzle surface 12*a*, the wiper 42 is first raised with the nozzle surface 12*a* removed to the side from directly above the wiper 42, the distal end of the wiper 42 is positioned slightly higher than the elevation of the nozzle surface 12*a*, and the inkjet head 12 is then moved along the carriage shaft 14 with the distal end of the wiper 42 rubbing against the nozzle surface 12*a*. This enables the distal end of the wiper 42 to wipe foreign matter and ink from the nozzle surface 12*a*.

When a print job ends and the inkjet head 12 is waiting at the standby position, the head cap 41 moves to the position where the edge portion 41*b* seals around the nozzle surface 12*a* in order to cap the nozzles. This inhibits an increase in the viscosity of the ink left in the nozzles during the standby state, and thus helps prevent nozzle clogging. The wiper 42 can also be raised synchronized to the timing of the inkjet head 12 moving to the standby position side or printing position side in a wiping process that wipes the nozzle surface 12*a* with the wiper 42.

If head cleaning becomes necessary due, for example, to nozzle clogging, a pump motor is driven with the head cap 41 moved to the position capping the ink nozzles, thereby creating a vacuum in the sealed space enclosed by the well 41*c* and nozzle surface 12*a*, and causing ink to be discharged from the nozzles in an ink vacuuming process.

A flushing process is executed regularly in order to keep the ink in the nozzles in a condition suitable for printing by positioning the inkjet head 12 opposite the head cap 41, and then discharging a predetermined amount of ink from all nozzles of the inkjet head 12, with no relationship to a specific printing operation, into the well 41*c* of the head cap 41 (flushing unit). A flushing process that discharges a larger volume of ink droplets at one time than the volume of ink droplets discharged in the regular flushing process may also be executed at a desired time to clean the print head and restore clogged nozzles.

The cleaning process may consist of the wiping process, ink suction process, or flushing process individually or in combination. Before these processes are executed, however, a nozzle check process to inspect the ink discharge condition of each nozzle is performed. Whether or not cleaning is needed can be determined based on the result of the nozzle check, and the head cleaning process may be executed as required.

Nozzle Check Mechanism

A nozzle check mechanism (nozzle check unit) for detecting defective nozzles is positioned in the head cleaning mechanism 40 for this nozzle check process.

More specifically, an absorbent material 41*d* (FIG. 7) for absorbing the vacuumed waste ink is held inside the well 41*c*, and a conductor 41*e* is provided for electrical conductivity with the absorbent material 41*d*. Electrical signals passing through the conductor 41*e* are extracted by a wire, for example. In this embodiment of the invention charged ink droplets are discharged from the nozzles of the inkjet head 12, and signals denoting the change in current produced when the charged ink lands on the absorbent material 41*d* are extracted. If this signal is less than or equal to a predetermined threshold value even though ink was discharged, it can be determined that a nozzle discharge defect has occurred.

Note that other methods of detecting defective nozzles may be used, including, for example, using a laser or other optical device to detect discharged ink droplets.

The nozzle check process more specifically discharges charged ink droplets from the nozzles of the inkjet head 12, and inspects the ink discharge state of each nozzle based on the current change signal detected when the discharged ink lands on the absorbent material 41*d* in the well 41*c*. When this nozzle check process is executed, the head cap 41 is positioned so that the gap L1 between the nozzle surface 12*a* and the top edge of the edge portion 41*b* of the head cap 41, and the gap L2 between the nozzle surface 12*a* and the surface of the absorbent material 41*d*, are predetermined sizes. The inkjet head 12 is then grounded and a voltage is applied to the head cap 41 side to create a specific electric field producing a specific potential difference between the inkjet head 12 and head cap 41. The ink discharged from the inkjet head 12 is charged to a specific charge by this electric field before the ink lands. This enables accurately inspecting the ink droplet discharge state.

Control System

Figure 8:
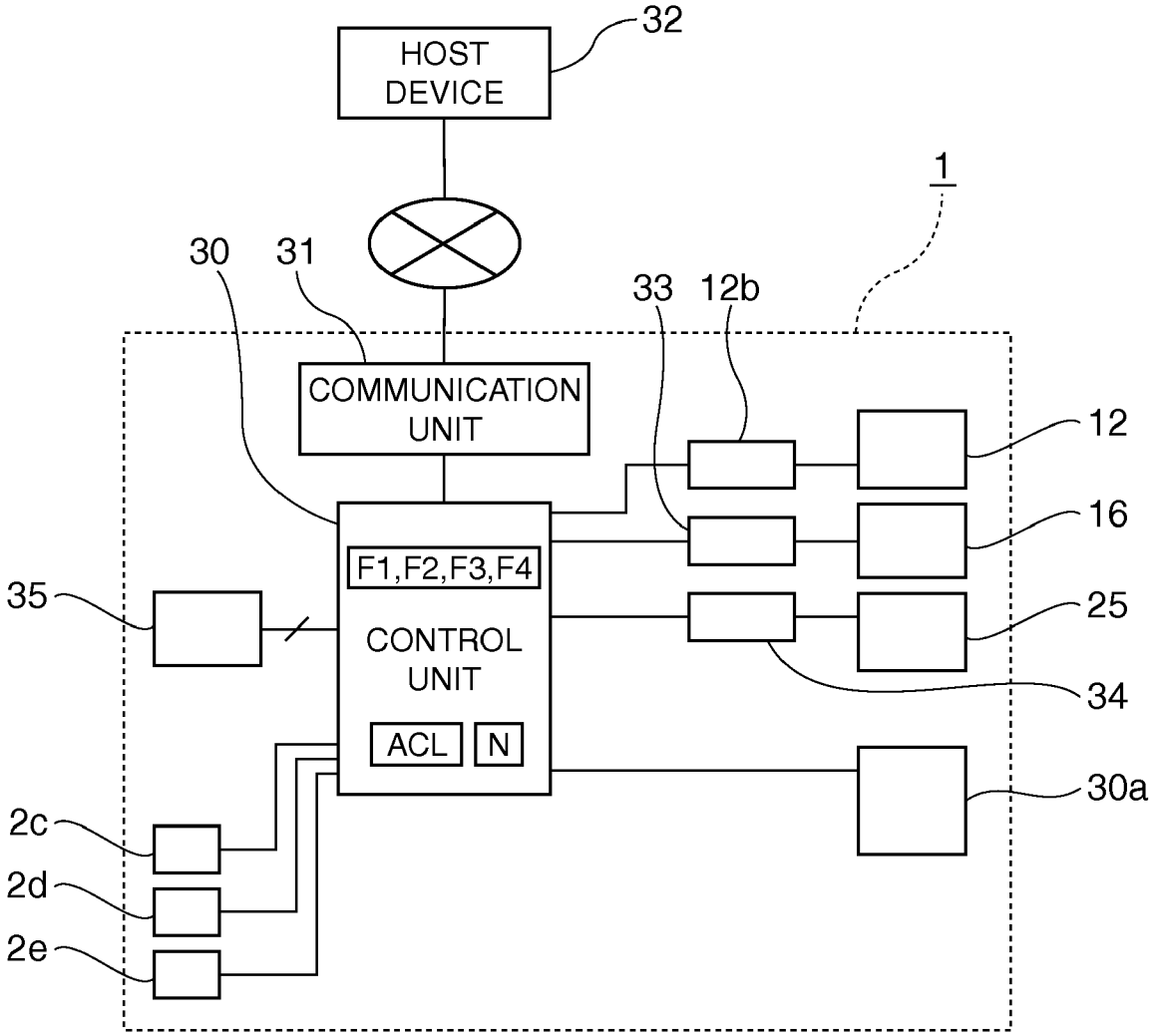
FIG. 8 is a schematic block diagram showing the control system of the inkjet printer.

FIG. 8 is a block diagram of the control system of the inkjet printer 1. The control system of the inkjet printer 1 is centered around a control unit 30 including a CPU, ROM, and RAM. Print data and commands are supplied from a host device 32 or other host terminal through a communication unit 31 to the control unit 30. Based on commands from the host device 32, for example, the control unit 30 controls driving other parts of the printer to convey the paper and print.

The inkjet head 12 is connected to the output side of the control unit 30 through the head driver 12*b*. The carriage motor 16 and paper transportation motor 25 are connected to the output side of the control unit 30 through motor drivers 33 and 34, respectively.

An operation input unit 30*a*, and the sensors 2*c*, 2*d*, and 2*e*, and a sensor group 35 positioned along the paper transportation path are connected to the input side of the control unit 30. Responsive to the detected outputs from the sensors, the control unit 30 controls the nozzle check process, head cleaning process, paper transportation process, and printing process. The control unit 30 also functions as a head cleaning control unit that executes the head cleaning process.

Head Cleaning Control

The head cleaning control operation of the inkjet printer 1 according to this embodiment of the invention is described next. When the head cleaning process is executed under a specific condition (a state corresponding to the defective nozzle occurrence condition) in which there is the possibility of defective nozzles, the first cleaning process that is executed is more intense than the usual cleaning process, thereby enabling completing the head cleaning process with the least possible number of cleaning operations and the least ink consumption.

As an example of the various cleaning processes that can be executed using the ink suction process, flushing process, and wiping process individually or in combination, the cleaning process described below selects and executes one of five ink suction processes that differ in the amount of ink that is vacuumed from the nozzles (that is, of different cleaning intensity) according to the defective nozzle occurrence condition and other execution conditions.

Before starting the head cleaning process, the control unit 30 detects if the inkjet printer 1 is in a defective nozzle occurrence condition as described in (1) to (5) below, and sets the corresponding flag accordingly.

(1) Timer AID Flag

The inkjet printer 1 executes the head cleaning process regularly or at a specified time. Therefore, if the control unit 30 detects from an internal timer that a predetermined time has passed since the most recent printing process or head cleaning process, it sets a timer AID flag. The timer AID flag may also be set when a predetermined time has passed since a specified process other than a printing process or head cleaning process.

(2) Impact Detection Flag

The control unit 30 sets the impact detection flag if it detects from the impact sensor 2*e* that a specific shock was applied to the inkjet printer 1. If the inkjet printer 1 detects a shock when the impact detection flag has already been set, the impact detection flag remains set.

(3) Startup Process Flag

When the power switch of the inkjet printer 1 turns on, when a startup signal or reset signal is input from the host device, or a reset signal is detected internally in the inkjet printer 1, the control unit 30 executes the startup process or restart process and sets the startup process flag.

(4) Suspend Head Cleaning Flag (AID Hold Flag)

If the head cleaning process that executes regularly or at a specified time cannot be run because, for example, the inkjet printer 1 is in the middle of a printing process when the time to start the head cleaning process arrives, the control unit 30 suspends the current head cleaning process and sets the suspend head cleaning flag (referred to below as the AID hold flag).

(5) Cover Closed Flag

The control unit 30 sets the cover closed flag in at least one of two situations, that is, when the open/close sensor 2*c* detects that the roll paper cover 2*a* of the inkjet printer 1 closed, and when the open/close sensor 2*d* detects that the ink cartridge cover 2*b* of the inkjet printer 1 closed. If the cover closed flag is already set and opening and closing of the roll paper cover 2*a* or ink cartridge cover 2*b* is detected again, the cover closed flag remains set.

The control unit 30 regularly checks if the timer AID flag is set and starts the head cleaning process if it detects that the timer AID flag is set. If a specific operation for starting the head cleaning process is performed at the operating unit of the inkjet printer 1, or an execute head cleaning process command is input from the host device, or an execute head cleaning process command from inside the inkjet printer 1 is detected, the control unit 30 starts the head cleaning process based on the user operation or the execute head cleaning process command irrespective of the timer AID flag setting.

Figure 9:
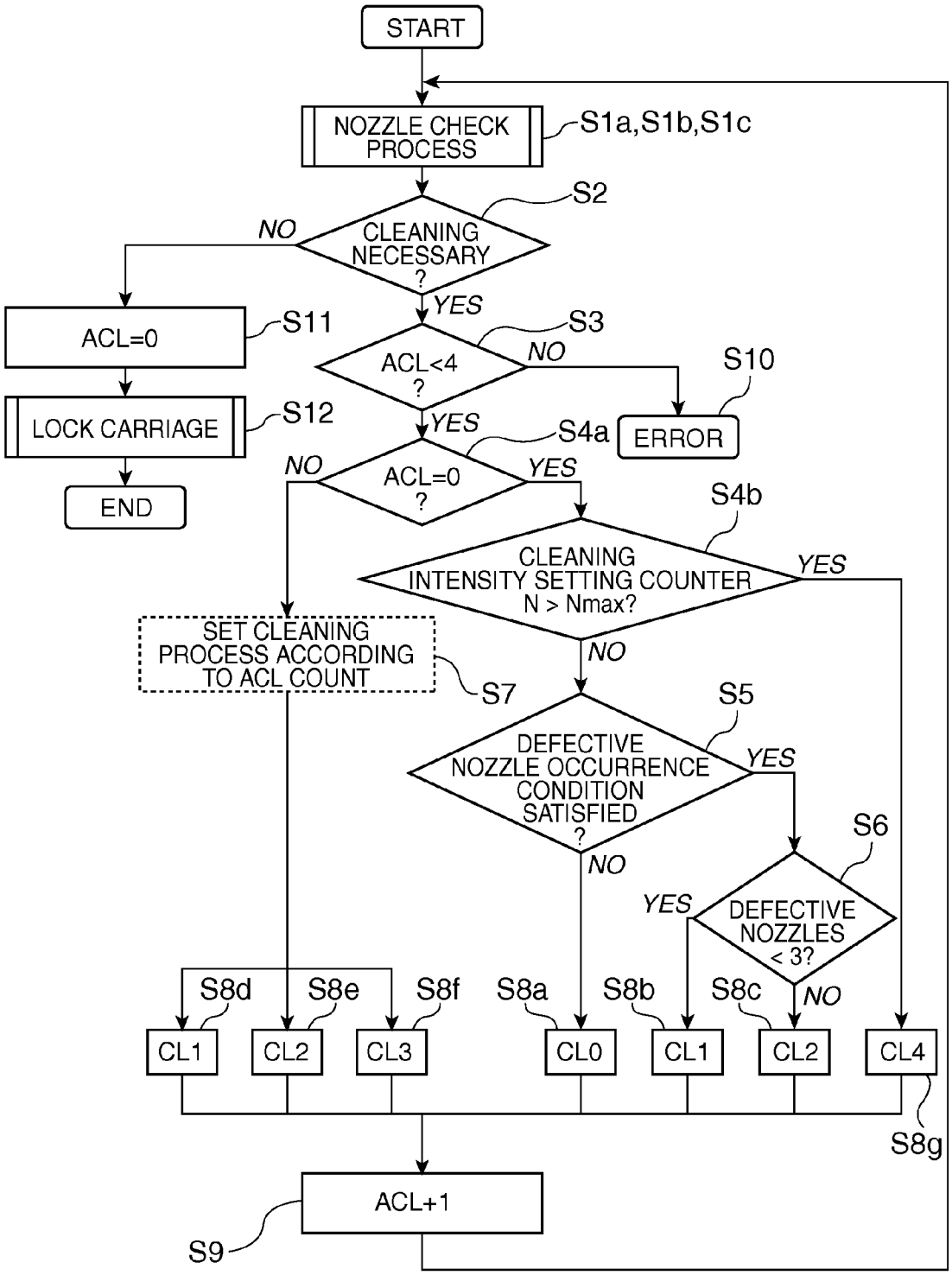
FIG. 9 is a flow chart showing the nozzle check and head cleaning operation.

FIG. 9 is a flow chart illustrating the head cleaning process.

When the head cleaning process starts, the control unit 30 executes a first nozzle check (step S1*a*). Whether cleaning is needed or not is then determined based on the result of defective nozzle detection in this nozzle check process (step S2). This cleaning requirement test determines that cleaning is needed if even one defective nozzle is found, and determines that cleaning is not needed if absolutely no defective nozzles are found. If the inkjet head 12 is not at the standby position when the head cleaning process starts, the inkjet head 12 is returned to the standby position before the first nozzle check (step S1*a*). The threshold value used in the cleaning requirement test (step S2) may be set as desired. For example, the cleaning process may be determined necessary if the number of defective nozzles is greater than or equal to n (where n is an integer of 2 or more).

If the control unit 30 determines in the cleaning requirement test (step S2) that cleaning is needed, the control unit 30 determines if the count of the cumulative counter ACL is or is not less than 4 (step S3).

The cumulative counter ACL is a counter that is part of the control unit 30, and each time the cleaning process executes the control unit 30 increments the cumulative counter ACL by one. The count kept by the cumulative counter ACL denotes how many times the head cleaning process was executed before the current head cleaning process. As described below, the cumulative counter ACL is reset at the completion of each head cleaning process, and at the beginning of each head cleaning process, therefore, ACL=0.

If the count kept by the cumulative counter ACL is less than 4 in step S3, the control unit 30 determines if the count of the cumulative counter ACL is 0 (step S4*a*). If the count of the cumulative counter ACL is 0 (step S4*a* returns Yes), indicating the cleaning process has not executed even once yet, the control unit 30 determines if the count Na of a cleaning intensity setting counter N exceeds a preset threshold value Nmax (step S4*b*).

The cleaning intensity setting counter N is an internal counter of the control unit 30, for example. If the ink cartridge cover 2*b* is opened during a flushing process as described below, the cleaning intensity setting counter N increments the count Na by ΔN1. The counter is also incremented when head cleaning is required before printing starts, and when cleaning (CL2) is required because a defective nozzle was detected in the nozzle check as described below (step S6 goes to step S8*c* in FIG. 9). In each of these cases the counter is incremented by a preset amount. In addition, the cleaning intensity setting counter is also incremented if the cumulative time that the head cap is open before printing starts is 4 hours or longer, and in this situation the head cleaning intensity is set according to the time passed since the last flushing operation.

If the count Na of the cleaning intensity setting counter N is greater than threshold value Nmax, the ink suction process (CL4) that vacuums the most amount of ink, that is, the ink suction process of the highest cleaning intensity, is selected as the cleaning process (step S8*g*).

If the count Na of the cleaning intensity setting counter N is less than or equal to the threshold value Nmax, the ink control goes to step S5 to determine if the timer AID flag, impact detection flag, startup process flag, AID hold flag, or cover closed flag described in (1) to (5) above is set (step S5).

If no flag is set (step S5 returns No), the ink suction process CL0 that removes the least amount of ink is selected as the cleaning process and run (step S8*a*). More specifically, the control unit 30 determines that the inkjet printer 1 is not in a defective nozzle occurrence condition, and therefore executes the cleaning process with the weakest cleaning intensity (CL0).

If one or more of the flags, that is, the timer AID flag, impact detection flag, startup process flag, AID hold flag, or cover closed flag, is set (step S5 returns Yes), the control unit 30 determines that the inkjet printer 1 is in a condition corresponding to at least one defective nozzle occurrence condition. As a result, the control unit 30 determines if the number of defective nozzles detected in the first nozzle check process (step S1) is less than 3 (step S6). Step S6 thus determines the degree of nozzle clogging based on the detected number of defective nozzles. If the number of defective nozzles is less than 3 (step S6 returns Yes), nozzle clogging is not that severe, and the ink suction process (CL1) that removes the second least amount of ink is selected as the cleaning process and run (step S8*b*).

However, if the number of defective nozzles is 3 or more (step S6 returns No), there are many defective nozzles and the ink suction process (CL2) that removes the third least amount of ink is selected as the cleaning process and run (step S8*c*).

By thus executing steps S4*b*, S5 and S6 before running the first cleaning process, the control unit 30 determines the intensity of the first cleaning process based on the count Na of the cleaning intensity setting counter N, the result of determining if the inkjet printer 1 is in a defective nozzle occurrence condition, and based on the determining if the detected number of defective nozzles is less than a predetermined threshold value. Note that the threshold value used for defective nozzle detection in step S6 may be a number other than 3.

After executing the cleaning process selected as the first cleaning process in step S8*a* to S8*c* or S8*g*, the control unit 30 increments the cumulative counter ACL by 1 (step S9). The control unit 30 then repeats the nozzle check process (step S1*b*: second nozzle check process). If a defective nozzle is found, processing continues to steps S3, S4*a* and S4*b*. After the cleaning process is executed once, the value of the cumulative counter ACL in step S4*a* is not 0 (step S4*a* returns No), and control therefore goes to step S7.

In step S7 the control unit 30 determines the content of the cleaning process based on the value of the cumulative counter ACL and ignores the defective nozzle occurrence condition and number of defective nozzles detected in the nozzle check process.

If in step S7 the count (ACL) of the cumulative counter ACL is 1, that is, this is the second head cleaning, the control unit 30 selects and executes the cleaning process (CL1) that removes the second least amount of ink (step S8*d*).

If ACL=2, that is, this is the third head cleaning, the control unit 30 selects and executes the cleaning process (CL2) that removes the third least amount of ink (step S8*e*).

If ACL=3, that is, this is the fourth head cleaning, the control unit 30 selects and executes the cleaning process (CL3) that removes the second most amount of ink (step S8*f*).

After executing the cleaning process selected as the second cleaning process in step S8*d* to S8*f*, the control unit 30 increments the cumulative counter ACL by 1 (step S9). The control unit 30 then repeats the nozzle check process (step S1*c*) and processing continues if a defective nozzle is found. The step of selecting and executing the ink suction process corresponding to the value stored by the cumulative counter ACL (step S8*d* to S8*f*), and the nozzle check process (step S1*c*), then repeat in order until control goes to the error handling step (step S10) or the head cleaning termination steps (step S11 and S12).

If the control unit 30 determines that the value of the cumulative counter ACL is not less than 4 in step S3 (step S3 returns No), an error is returned (step S10) because defective nozzles are still being found even though the cleaning process has been executed at least a predetermined number of times. This error handling step may send an error signal denoting a cleaning error to the host device to display an error message on the display of the host device, or cause an error indicator on the inkjet printer 1 to light or an error message to be displayed on the liquid crystal display device of the inkjet printer 1, or cause an audible alarm to sound, for example.

If not even one defective nozzle is found by the nozzle check process (step S1*a* to S1*c*), the control unit 30 determines in the cleaning requirement test that cleaning is not needed (step S2 returns No), and resets the cumulative counter ACL to 0 (step S11). The inkjet head 12 is then returned to the standby position and the carriage 12 is locked (step S12). This completes the head cleaning process. When head cleaning is completed normally, the control unit 30 clears the timer AID flag, impact detection flag, startup process flag, AID hold flag, and cover closed flag.

Flushing Control Process

The flushing control process of the inkjet printer 1 is described next. Flushing occurs at preset times, such as when the power turns on or at a specific interval. When the control unit 30 detects the preset time for the flushing operation, it moves the inkjet head 12 to the standby position opposite the head cap and flushes the nozzles by discharging ink droplets from the nozzles with no relationship to a specific printing process.

Figure 10:
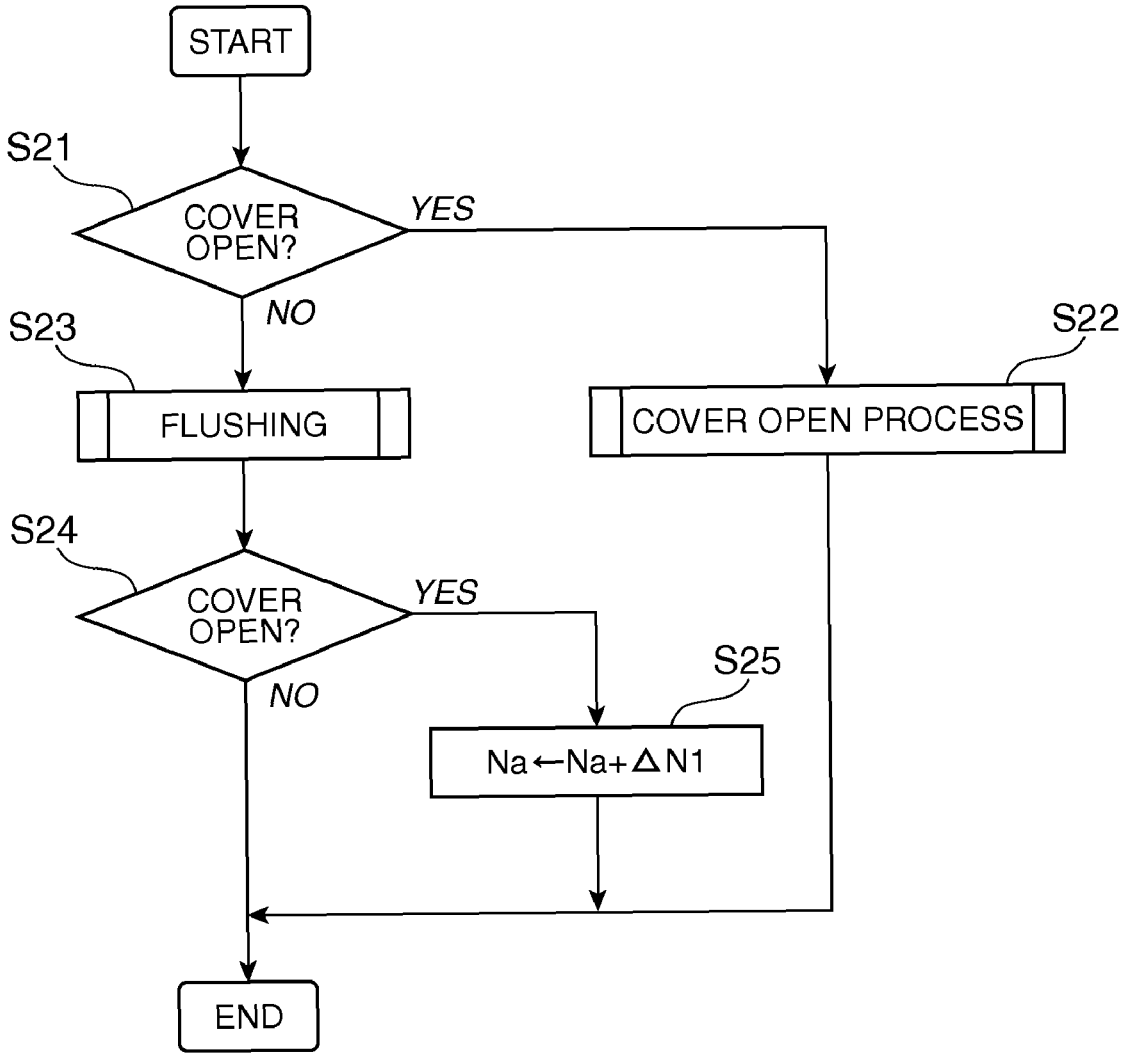
FIG. 10 is a flow chart of the flushing control operation.

FIG. 10 is a flow chart of the flushing control process.

When the control unit 30 determines it is time to execute the flushing process, it first checks the open or closed status of the ink cartridge cover 2*b* by checking the input from the open/close sensor 2*d* (step S21). If the ink cartridge cover 2*b* is open (step S21 returns Yes), a specific cover open process including a process that closes the valve 74 executes (step S22), and the process then ends. The start of flushing then waits until the open/close sensor 2*d* detects that ink cartridge cover 2*b* closes.

If the open/close sensor 2*d* detects that the ink cartridge cover 2*b* is closed, flushing starts (step S23). The open or closed state of the ink cartridge cover 2*b* is then checked again immediately after flushing (step S24) by checking the input from the open/close sensor 2*d*. More specifically, this step checks if the ink cartridge cover 2*b* was opened while flushing the nozzles. If the ink cartridge cover 2*b* was not opened (step S24 returns No), operation ends. If it is detected that the ink cartridge cover 2*b* was opened (step S24 returns Yes), the count Na of the cleaning intensity setting counter N that determines the cleaning intensity of the cleaning process as described above is incremented by a preset amount ΔN1 (step S25), and operation then ends. This step of incrementing the counter accelerates the timing at which the cleaning process (C4) that discharges the most amount of ink (the cleaning process with the highest cleaning intensity) next executes.

As described above, the inkjet printer 1 detects if the ink cartridge cover 2*b* is open before starting the flushing operation, and does not flush the nozzles if the cover is open in order to prevent bubbles from entering the ink supply path. It is therefore possible to prevent the problem of defective nozzles that are caused by bubbles entering from the end of the ink supply needle 72 of an ink supply path 73 that is open to the air.

In addition, when opening of the ink cartridge cover 2*b* during the flushing operation is detected, ΔN1 is added to the count Na of the cleaning intensity setting counter N. As a result, the time until the cleaning process (CL4) with the highest cleaning intensity executes is shortened. Therefore, even if a bubble enters from the end of the ink supply needle 72 of an ink supply path 73 open to the air during the flushing operation, the bubbles can be removed at an earlier time using the strongest cleaning process (CL4).

When the ink cartridge cover 2*b* is opened during the flushing operation in the embodiment described above, a specific value ΔN1 is added to the count Na of the cleaning intensity setting counter N to accelerate the time when the strongest cleaning operation (CL4) is executed. Alternatively, however, opening the ink cartridge cover 2*b* during the flushing operation may be set as a defective nozzle occurrence condition and the cleaning process (CL2 or CL1) with the third or fourth cleaning intensity may be executed (step S5, S6, S8*b*, S8*c*). Further alternatively, when opening the ink cartridge cover 2*b* during the flushing operation is detected, a cleaning process (CL3) that discharges more ink than the cleaning process executed when another defective nozzle occurrence condition occurs may be executed.

The foregoing embodiment executes five different ink suction processes (CL0-CL4) with different ink suction amounts as the cleaning process, but a flushing process or wiping process may be executed, or different processes may be combined. Further alternatively, the vacuum power used or the amount of ink vacuumed out in the ink suction process, the amount of ink discharged in the flushing process, or other parameter may be changed appropriately. Further alternatively, the volume of ink vacuumed or discharged may be changed according to the number of defective nozzles detected in the immediately preceding nozzle check.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A fluid droplet discharge device comprising:

a fluid tank loading unit;

an access cover that opens and closes the fluid tank loading unit;

a cover linking mechanism that connects a fluid supply opening of a fluid tank set in the fluid tank loading unit to a fluid supply path that supplies fluid to a fluid droplet discharge head when the access cover closes, and disconnects the fluid supply opening from the fluid supply path when the access cover opens;

an open/close sensor that detects opening and closing of the access cover;

a fluid suction unit that vacuums fluid from the nozzles of the fluid droplet discharge head;

a nozzle check unit that detects if a nozzle of the fluid droplet discharge head is a defective nozzle;

a flushing unit that flushes by discharging fluid droplets from each nozzle of the fluid droplet discharge head; and a head cleaning control unit that executes a cleaning process using the fluid suction unit to recover the defective nozzle when a defective nozzle is detected by the nozzle check unit only after the open/close sensor detects that the access cover is closed, and that changes at least one of the cleaning intensity and the execution timing of a cleaning process executed after flushing if opening of the access cover is detected while flushing.

2. The fluid droplet discharge device described in claim 1, further comprising:

a cleaning intensity setting counter in which the count is incremented according to the occurrence of predetermined events, said predetermined events including detecting that the access cover is open, and wherein the head cleaning control unit executes a cleaning process with the highest cleaning intensity when the count of the cleaning intensity setting counter exceeds a predetermined threshold value.

3. The fluid droplet discharge device described in claim 2, further comprising:

a valve that can close the fluid supply path;

wherein the head cleaning control unit is responsive to the open/close sensor detecting that the access cover is open or closed before executing the flushing process, and if the access cover is open, operates the valve to close the fluid supply path and then executes the flushing operation when closing of the access cover is detected by the open/close sensor.

4. The fluid droplet discharge device described in claim 1, wherein:

the head cleaning control unit increases the cleaning intensity by at least one of applying control to increase the fluid suction volume of the fluid suction unit and applying control to increase the fluid suction power.

* * * * *